US010376129B2

(12) United States Patent
Kangas et al.

(10) Patent No.: US 10,376,129 B2
(45) Date of Patent: Aug. 13, 2019

(54) DISHWASHER LEVELING ASSEMBLY

(71) Applicant: WHIRLPOOL CORPORATION, Benton Harbor, MI (US)

(72) Inventors: William K. Kangas, Buchanan, MI (US); Thomas M. O'Brien, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/345,886

(22) Filed: Nov. 8, 2016

(65) Prior Publication Data

US 2018/0125324 A1 May 10, 2018

(51) Int. Cl.

| | |
|---|---|
| ***A47L 15/42*** | (2006.01) |
| ***A47L 15/50*** | (2006.01) |
| ***A47L 15/22*** | (2006.01) |

(52) U.S. Cl.

CPC ..... *A47L 15/4253* (2013.01); *A47L 15/22* (2013.01); *A47L 15/4225* (2013.01); *A47L 15/4261* (2013.01); *A47L 15/4285* (2013.01); *A47L 15/502* (2013.01); *A47L 15/507* (2013.01)

(58) Field of Classification Search

CPC .. A47L 15/502; A47L 15/507; A47L 15/4253; A47L 15/22; A47L 15/4225; A47L 15/4261; A47L 15/4285; A47B 91/022; A47B 91/024; A47B 2220/003; F16M 7/00; F25D 23/00

See application file for complete search history.

(56) References Cited

U.S. PATENT DOCUMENTS

| | | | | | |
|---|---|---|---|---|---|
| 1,934,746 | A * | 11/1933 | Stoddard | A47B 91/028 | 248/188.4 |
| 3,175,795 | A * | 3/1965 | Adams | A47B 91/024 | 248/188.4 |
| 3,191,212 | A * | 6/1965 | Hahn | A47B 91/066 | 16/42 R |
| 3,741,067 | A * | 6/1973 | Moran | F16B 33/006 | 411/39 |
| 3,844,518 | A * | 10/1974 | Long | A47B 91/024 | 248/188.4 |
| 4,657,458 | A * | 4/1987 | Wollar | F16B 37/043 | 411/182 |
| 4,949,923 | A | 8/1990 | Daily | | |
| 5,039,266 | A * | 8/1991 | Nagayoshi | F16B 37/0885 | 411/433 |
| 5,743,618 | A * | 4/1998 | Fujino | B60Q 1/0683 | 362/515 |
| 5,826,847 | A * | 10/1998 | Warner | F16B 7/1463 | 248/354.1 |

(Continued)

FOREIGN PATENT DOCUMENTS

| | | |
|---|---|---|
| EP | 1633218 B1 | 8/2007 |
| EP | 2409631 A2 | 1/2012 |

(Continued)

*Primary Examiner* — Hanh V Tran

(74) *Attorney, Agent, or Firm* — McGarry Bair PC

(57) ABSTRACT

A dishwasher with a tub defining a treating chamber, a chassis supporting the tub, and a set of leveling assemblies mounted to the chassis. A leveling assembly can include a leveling foot having a threaded shaft and a nut having a threaded interior and a flexible or moveable portion configured to receive a portion of the threaded shaft.

11 Claims, 8 Drawing Sheets

(56) References Cited

U.S. PATENT DOCUMENTS 5,967,472 A * 10/1999 Wilhelmstatter .... A47B 91/028 248/188.2
6,146,076 A * 11/2000 Bodin ..... F16B 37/0828 211/187
6,520,461 B1 * 2/2003 Graham ..... A47B 91/024 248/157
6,957,865 B1 * 10/2005 Adams ..... A47B 91/024 297/344.12
7,484,700 B2 * 2/2009 Selle ..... A47B 91/024 248/188.4
7,594,513 B2 9/2009 Vanderroest et al.
7,695,080 B2 * 4/2010 Chen ..... A47B 88/427 312/333
9,664,219 B2 * 5/2017 Haider ..... F16B 12/00
2003/0136887 A1 * 7/2003 Gabriel ..... A47L 15/4253 248/188.2
2004/0238716 A1 * 12/2004 George ..... A47B 91/005 248/649
2005/0247834 A1 * 11/2005 Thuelig ..... A47L 15/4253 248/188.4
2006/0102815 A1 * 5/2006 Erdmann ..... A47L 15/4253 248/188.2
2006/0266896 A1 * 11/2006 Balistreri ..... A47B 91/024 248/188.4
2007/0262213 A1 * 11/2007 de Toledo ..... A47L 15/4253 248/188.8
2008/0168855 A1 * 7/2008 Giefer ..... A47B 91/024 74/412 R
2009/0001246 A1 * 1/2009 Phillips ..... A47L 15/4253 248/680
2010/0243847 A1 * 9/2010 Kucuk ..... A47L 15/4253 248/346.03
2010/0276564 A1 * 11/2010 Fetzer ..... A47B 91/028 248/678
2011/0198458 A1 * 8/2011 Karl ..... A47B 91/024 248/188.4
2011/0266935 A1 * 11/2011 Baldwin ..... A47L 15/507 312/228.1
2011/0297802 A1 * 12/2011 Gennaretti ..... A47L 15/4253 248/188.4
2012/0091299 A1 * 4/2012 Levine ..... A47B 91/022 248/188.4
2013/0119848 A1 * 5/2013 Kim ..... A01M 1/2011 312/405
2013/0156497 A1 * 6/2013 Haider ..... A47B 91/022 403/343
2013/0240688 A1 * 9/2013 Schwartz ..... A47B 91/024 248/125.8
2016/0081474 A1 * 3/2016 Basesme ..... A47L 15/4253 248/188.4
2016/0235200 A1 * 8/2016 De Bruin ..... A47B 91/02
2017/0172376 A1 * 6/2017 Son ..... A47L 15/4253
2017/0245640 A1 * 8/2017 Cheng ..... A47B 91/024

FOREIGN PATENT DOCUMENTS

EP 2326232 B1 8/2016
FR 2461880 A3 2/1981
JP 10227393 A * 8/1998 ..... A47L 15/4253
KR 101235981 B1 2/2013

* cited by examiner

DISHWASHER LEVELING ASSEMBLY

BACKGROUND OF THE INVENTION

Contemporary automatic dishwashers for use in a typical household include a cabinet or chassis that can provide support for a tub provided within the chassis. It is important that the chassis of the dishwasher is level or balanced so that performance is not affected. Furthermore, an unbalanced chassis can lead to liquid accumulation in low areas, which can cause, among other problems, odor, mold, and mildew.

BRIEF DESCRIPTION OF THE INVENTION

In one aspect, the present disclosure relates to a dishwasher for treating dishes according to at least one automatic cycle of operation, including a tub at least partially defining a treating chamber, a chassis at least partially supporting the tub, and a set of leveling assemblies mounted to the chassis. A leveling assembly including a leveling foot having a threaded shaft and a nut having a threaded interior and a flexible or moveable portion configured to receive a portion of the threaded shaft without threading the leveling foot, wherein when the threaded shaft is located within the nut, the nut is configured to be snap-fitted to the chassis such that the nut is constrained and the leveling foot is rotatable within the constrained nut for height adjustment of the chassis.

In another aspect, the present disclosure relates to a leveling assembly for a dishwasher, including a leveling foot having a threaded shaft and a nut having a threaded interior and a flexible or moveable portion configured to receive a portion of the threaded shaft without threading of the leveling foot, wherein when the threaded shaft is located within the nut, the nut is configured to be snap-fitted to the chassis such that the nut is constrained and the leveling foot is rotatable within the constrained nut for height adjustment of the chassis.

In yet another aspect, the present disclosure relates to a method for installing a leveling assembly on a dishwasher, including locating a threaded portion of a leveling foot having a screw body into a leveling nut having internal threads without threading the screw body into the leveling nut, and mounting the leveling nut, with the threaded portion located within the leveling nut, to a base portion of the dishwasher.

DESCRIPTION OF EMBODIMENTS OF THE INVENTION

Figure 1:
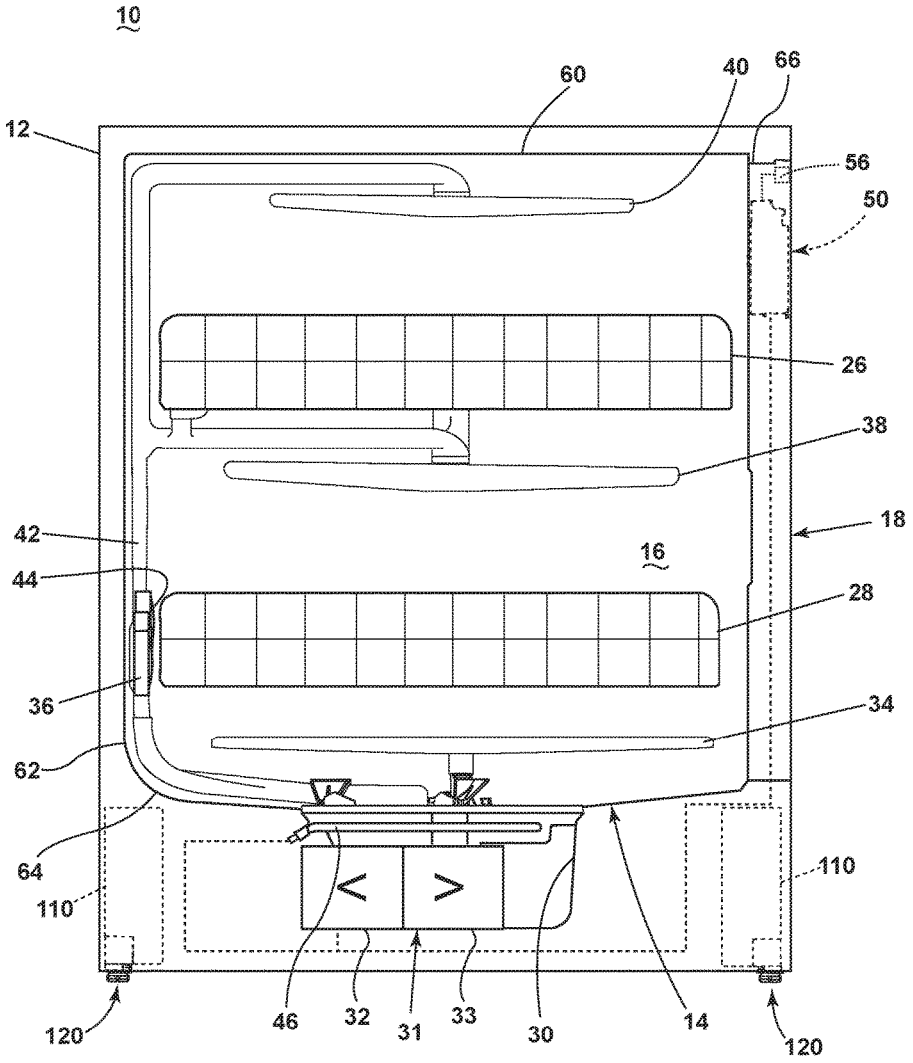
FIG. 1 is a schematic, cross-sectional view of a dishwasher according to an aspect of the present disclosure.

In FIG. 1, an automated dishwasher 10 according to aspects of the present disclosure is illustrated. The dishwasher 10 shares many features of a conventional automated dishwasher, which will not be described in detail herein except as necessary for a complete understanding. A chassis 12 can define an interior of the dishwasher 10, including a space below the tub 14 and can include a frame, with or without panels mounted to the frame. By way of non-limiting example, base supports 110 can be included in the chassis 12. Further, leveling assemblies 120 can be included in each corner 112 to help level the chassis 12. An open-faced tub 14 can be provided within the chassis 12 and can at least partially define a treating chamber 16, having an open face, for washing dishes. A door assembly 18 can be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, user access to the treating chamber 16 can be prevented, whereas user access to the treating chamber 16 can be permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders can be provided, such as a silverware basket. As used in this description, the term "dish(es)" is intended to be generic to any item, single or plural, that can be treated in the dishwasher 10, including, without limitation, dishes, plates, pots, bowls, pans, glassware, and silverware. While the dishwasher 10 is shown with two dish racks, any number of dish racks can be included.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system can include a sump 30 and a pump assembly 31. The sump 30 collects the liquid sprayed in the treating chamber 16 and can be formed by a sloped or recess portion of a bottom wall of the tub 14. The pump assembly 31 can include both a drain pump 32 and a recirculation pump 33. The drain pump 32 can draw liquid from the sump 30 and pump the liquid out of the dishwasher 10 to a household drain line (not shown). The recirculation pump 33 can draw liquid from the sump 30 and the liquid can be simultaneously or selectively pumped through a supply tube 42 to each of the assemblies 34, 36, 38, 40 for selective spraying. While not shown, a liquid supply system can include a water supply conduit coupled with a household water supply for supplying water to the treating chamber 16.

A heating system including a heater 46 can be located within the sump 30 for heating the liquid contained in the sump 30.

A controller 50 can also be included in the dishwasher 10, which can be operably coupled with various components of the dishwasher 10 to implement a cycle of operation. The controller 50 can be located within the door 18 as illustrated, or it can alternatively be located somewhere within the chassis 12. The controller 50 can also be operably coupled with a control panel or user interface 56 for receiving user-selected inputs and communicating information to the user. The user interface 56 can include operational controls such as dials, lights, switches, and displays enabling a user to input commands, such as a cycle of operation, to the controller 50 and receive information.

Figure 2:
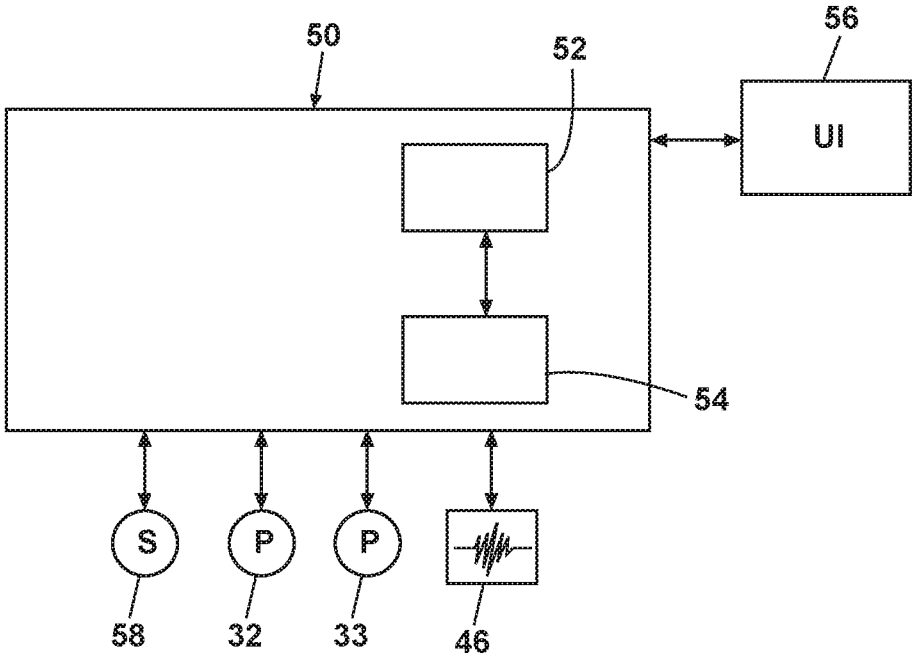
FIG. 2 is a schematic view of a controller of the dishwasher of FIG. 1.

As illustrated schematically in FIG. 2, the controller 50 can be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 can be provided with a memory 52 and a central processing unit (CPU) 54. The memory 52 can be used for storing control software that can be executed by the CPU 54 in completing a cycle of operation using the dishwasher 10 and any additional software. For example, the memory 52 can store one or more pre-programmed cycles of operation that can be selected by a user and completed by the dishwasher 10. The controller 50 can also receive input from one or more sensors 58. Non-limiting examples of sensors that can be communicably coupled with the controller 50 include a temperature sensor and turbidity sensor to determine the soil load associated with a selected grouping of dishes, such as the dishes associated with a particular area of the treating chamber.

Figure 3:
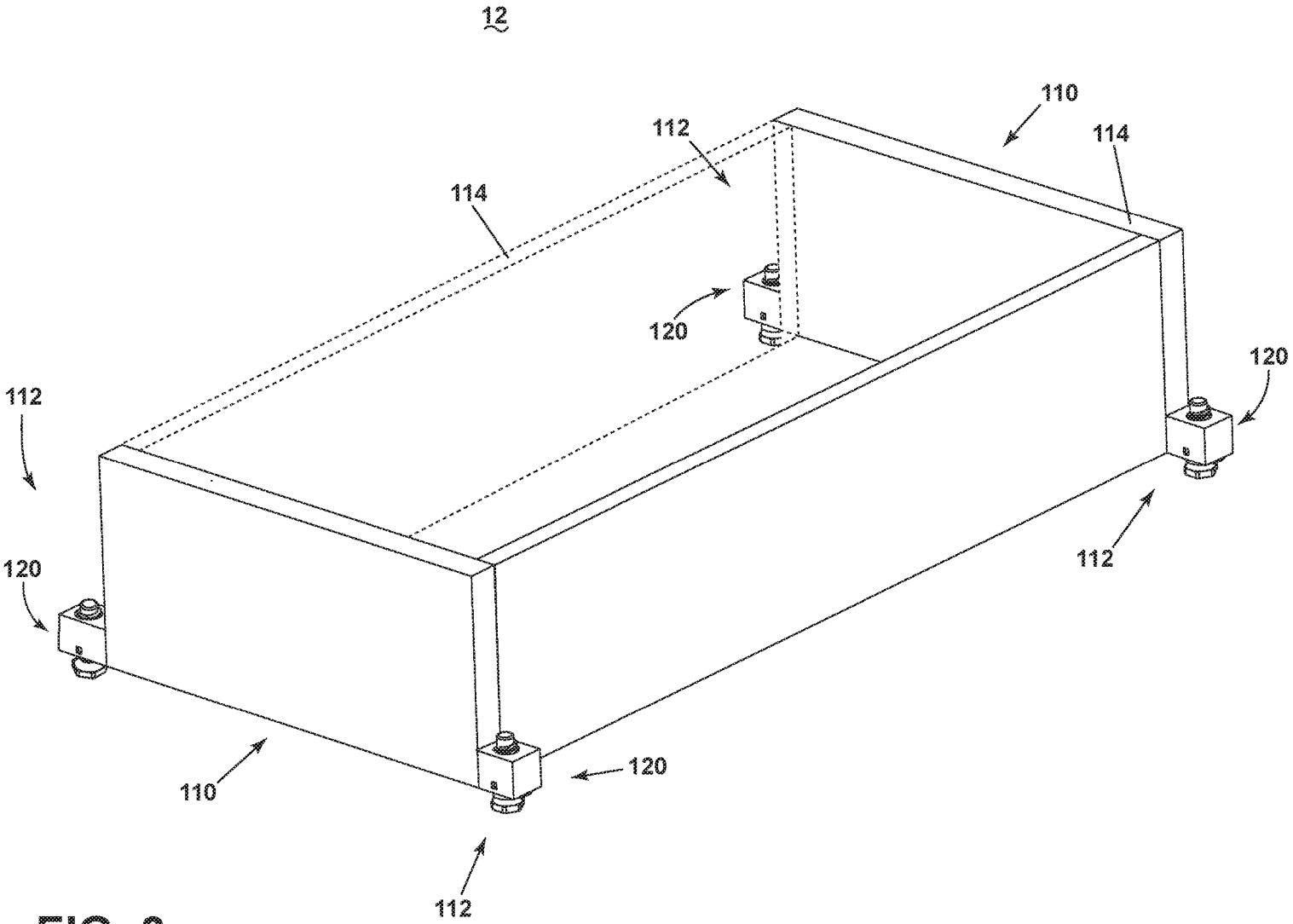
FIG. 3 is a perspective view of a portion of a chassis according to aspects of the present disclosure.

FIG. 3 illustrates a perspective view of a portion of the chassis 12 according to an exemplary aspect of the disclosure. The chassis 12 can include two opposing base supports 110, which can be coupled by cross supports 114 or any suitable method of connecting the base supports 110. Alternatively, the chassis can include an integral piece. In the illustrated example, each base support 110 includes leveling assemblies 120. The leveling assembly 120 can be mounted to the chassis 12 in a corner 112 of the base support 110. It is contemplated that the leveling assembly 120 can be mounted to the chassis 12 in alternate locations and are not limited to corners 112. For example, it is possible for a leveling assembly 120 to be mounted to a middle of the base support 110.

Figure 4:
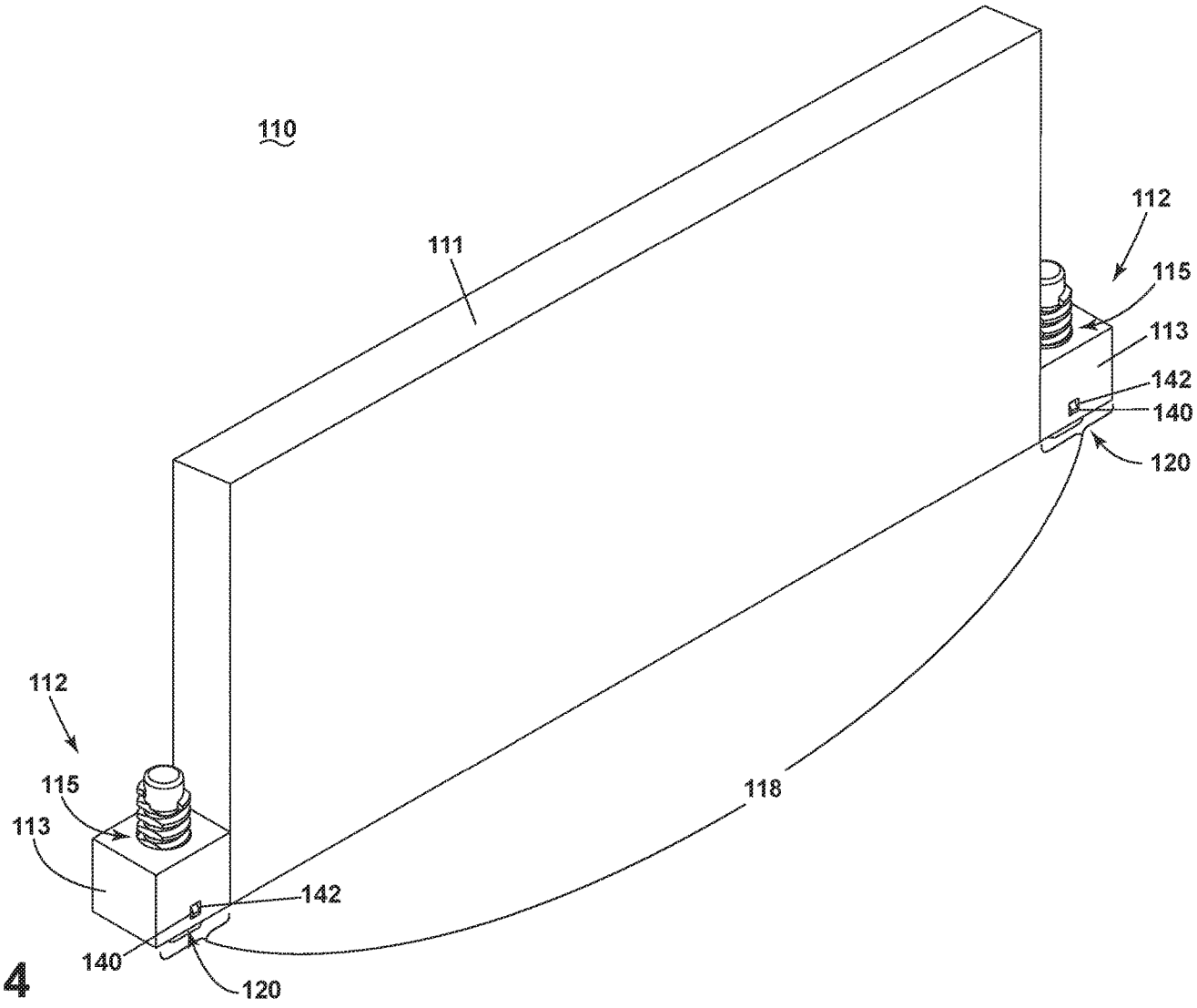
FIG. 4 is a perspective view of a base support of the portion of the chassis of FIG. 3 along with a leveling assembly according to aspects of the present disclosure.

FIG. 4 illustrates the base support 110 having a set of leveling assemblies 120 in more detail. The base support 110 includes a panel portion 111 that extends along the width of the dishwasher 10. The panel portion 111 can include support housings 113 in the corners 112. The support housings 113 can include an opening 115 and notches 142. The opening 115 extends the height of the support housing 113 and is configured to allow for movement of portions of the leveling assembly 120. The notches 142 and remainder of the support housing 113 are formed such that the leveling assembly 120 can be contained within the support housing 113. More specifically, the leveling assembly is secured within the support housing when projection(s) 140 on the leveling assembly mate with the notch(es) 142.

Figure 5:
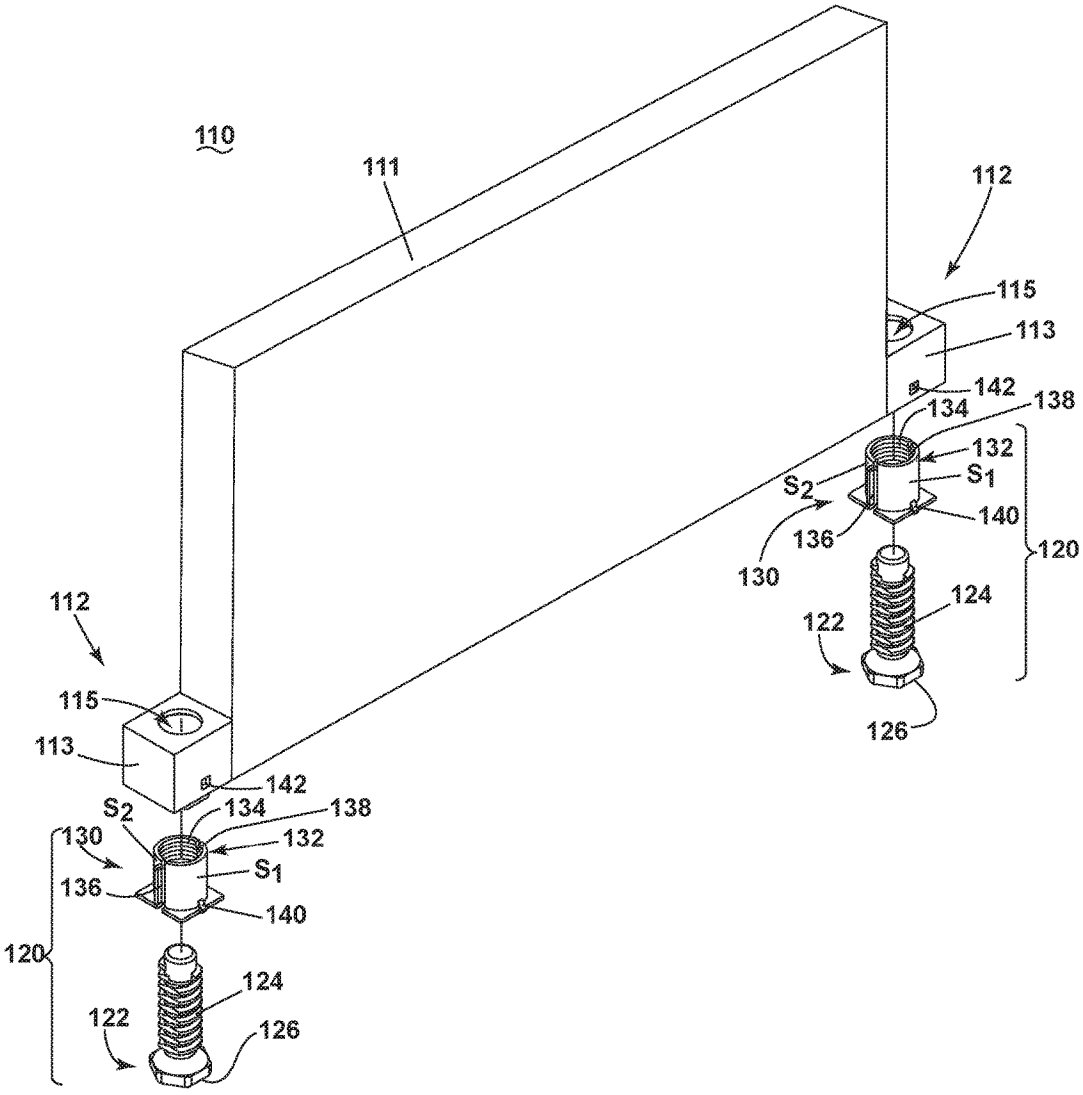
FIG. 5 is an exploded, perspective view of the base support and leveling assembly of FIG. 4.

FIG. 5 illustrates an exploded view of the base support 110 and set of leveling assemblies 120 and provides a clearer view of aspects of the disclosure. The leveling assembly 120 as illustrated includes a leveling foot 122 and a nut 130. The leveling foot 122 can include a threaded shaft 124 and a head 126. The threaded shaft 124, or screw body, provides for height adjustment while the head 126 abuts the surface on which the appliance, such as the dishwasher 10, stands on. The surface can be in the form of a floor, a platform, or any other surface the appliance stands on.

The nut 130 has been illustrated as including a threaded interior 134 and a moveable, or flexible portion 132. More specifically, in the illustrated example, the nut 130 includes a clam-shell body 132 with opposing first and second sides, or hinged portions, $S_1$ and $S_2$ that are joined by a hinge 138 located between the two opposing sides $S_1$ and $S_2$ and selectively locked together with a clasp 136. At least one of the first and second sides $S_1$ and $S_2$ can include the projection 140 extending from the clam-shell body 132 that can be configured to be received in, or mate with, the notch 142 in the support housing 113.

Figure 6A:
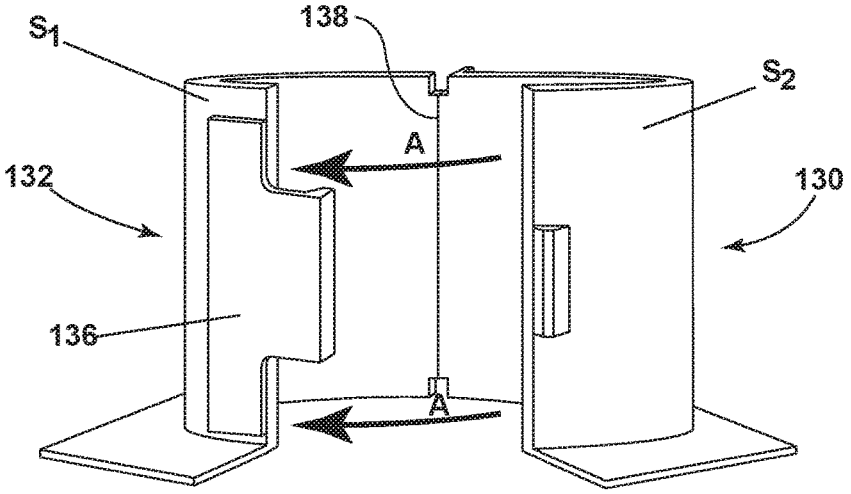
FIG. 6A is a perspective view of a nut of the leveling assembly illustrated in FIG. 4 with a moveable portion in an open position.
Figure 6B:
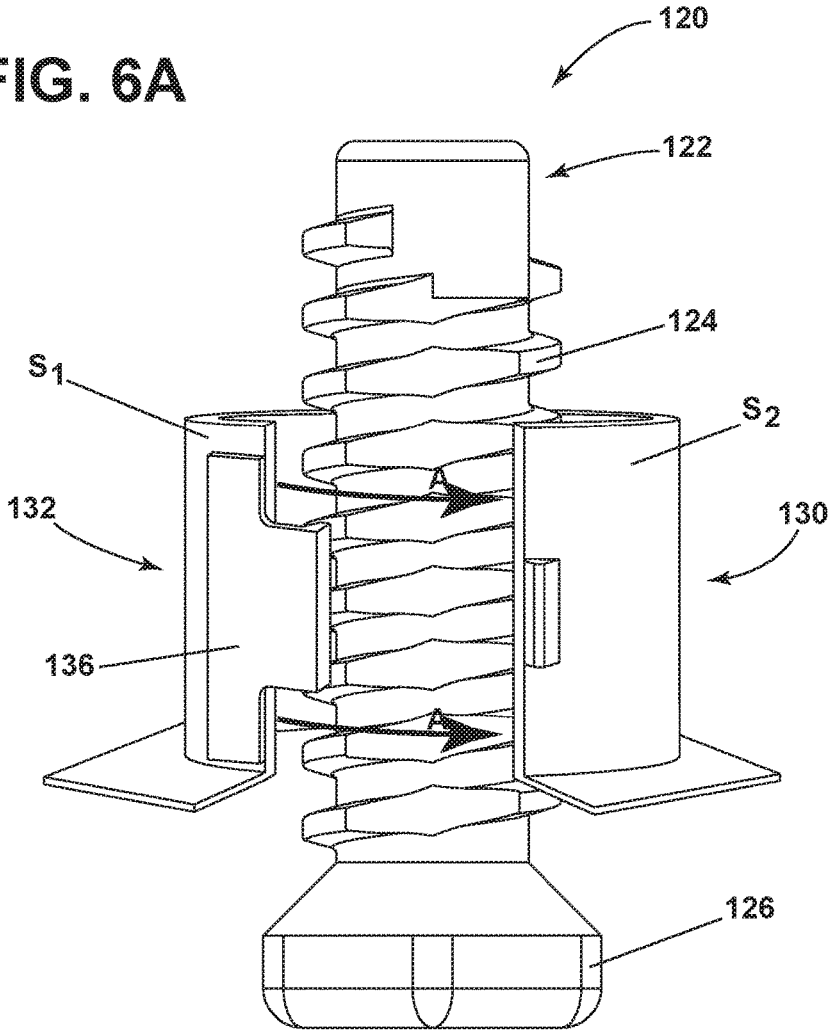
FIG. 6B is a perspective view of the nut of FIG. 6A with a threaded portion of the leveling foot inserted therein.

Turning to FIG. 6A, the nut 130 with the clam-shell body 132 is illustrated in an open position. The first and second sides, $S_1$ and $S_2$, of the clam-shell body 132 are configured to move between an opened position (FIG. 6A) and a closed position (FIG. 7) demonstrated by arrows A. When the nut 130 is in the opened position, it can receive the threaded shaft 124 as shown in FIG. 6B without threading, or rotating, the leveling foot 122. Upon receiving the threaded shaft 124, the opposing sides $S_1$ and $S_2$ can be moved together (in the direction of arrows A) and locked together in a closed position with the clasp 136. Together the nut 130 and leveling foot 122 form the leveling assembly 120, which can then be snap-fitted into the support housing 113 on the chassis 12. It will be understood that the clasp 136 can be replaced with any suitable closing or fastening device and that the first and second sides, $S_1$ and $S_2$, of the clam-shell body 132 can be locked together around the threaded shaft 124 in any suitable manner. For example, the sides $S_1$ and $S_2$ can alternatively be locked together by a strike and catch, or other types of latches, hinges, or hooks.

Figure 8:
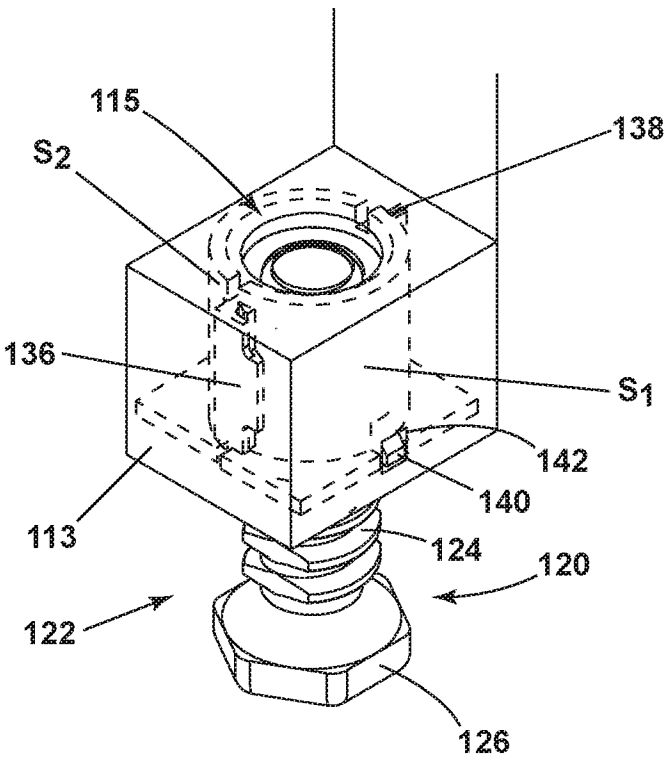
FIG. 8 is the leveling assembly of FIG. 7 with the leveling foot set to a different height.
Figure 7:
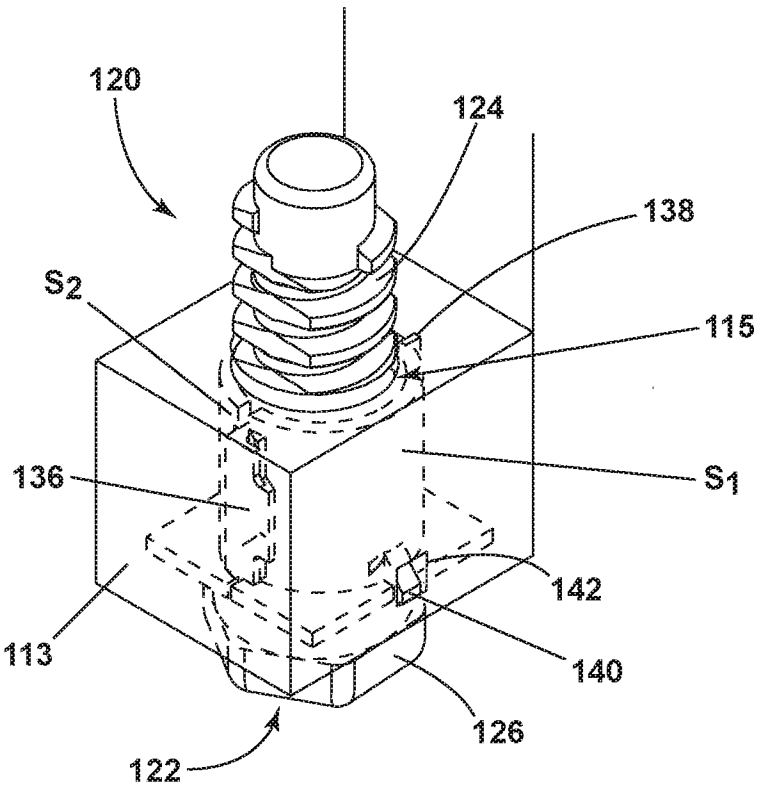
FIG. 7 is an enlarged view of the leveling assembly in FIG. 4 with the leveling foot in a first position.

After, the nut 130 has been closed around the threaded shaft 124, the leveling assembly 120 can be mounted to the base support 110. FIG. 7 illustrates the leveling assembly 120 located within the base support 110. The projection(s) 140 mate with corresponding notch(es) 142 and allow the clam-shell body 132 to be snap-fitted into the base support 110 when the leveling assembly 120 is received in the opening 115 of the support housing 113. Thus, the nut 130 is constrained. The leveling foot 122 is rotatable within the constrained nut 130 for height adjustment of the base support 110 to balance or level the chassis 12 and dishwasher 10. The leveling foot 122 is illustrated in an exemplary first position in FIG. 7 where the leveling foot 122 extends through the opening 115 in the support housing 113. FIG. 8 illustrates the leveling foot 122 set to a different height or an exemplary second position. The leveling foot 122 can be rotated within the constrained nut 130 so that the threaded shaft 124 spirals up and down, within the threaded interior 134 of the nut 130, and therefore adjusting the height of the base support 110.

Figure 9:
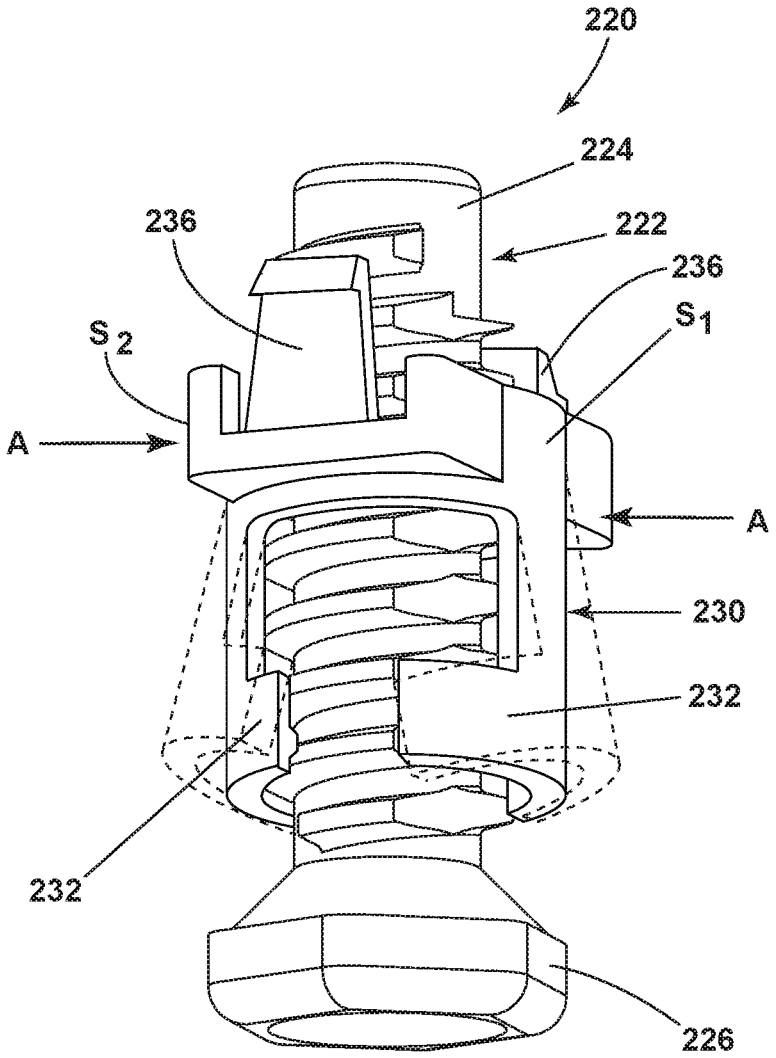
FIG. 9 is a perspective view of a leveling assembly that can alternatively be utilized in the dishwasher of FIG. 1.

Turning to FIG. 9, another exemplary leveling assembly 220 according to aspects of the present disclosure is illustrated. The leveling assembly 220 is similar to the leveling assembly 120; therefore, like parts will be identified with like numerals increased by 100, with it being understood that the description of the like parts of the leveling assembly 120 applies to the leveling assembly 220, unless otherwise noted. The leveling assembly 220 differs from the leveling assembly 120 with respect to the nut 230. The nut 230 includes a set of flexible, or moveable prongs 232, with prongs 232 being coupled to each of the first and second sides, $S_1$ and $S_2$ of the nut 230. While not shown, the prongs 232 can comprise a threaded interior. The nut 230 with the set of prongs 232 is illustrated in a closed position with lines in phantom illustrating an expanded or opened position. Applying pressure to first and second sides, $S_1$ and $S_2$ of the nut 230, as indicated by the arrows A, flexes the prongs 232 to the opened position. When the prongs 232 of the nut 230 are in the opened position, the nut 230 can allow the threaded shaft 224 to slip past a threaded interior of the prongs 232. When the threaded shaft 224 is received in the nut 230 and pressure is released from first and second sides, $S_1$ and $S_2$, the prongs 232 can move back to an engaged, or closed position, forming the leveling assembly 220, which can then be mounted to the chassis 12. The set of prongs 232 may alternatively be moved to the expanded position as the threaded shaft 224 is press-fit into the nut 230.

The nut 230 can include a locking feature, shown in the form of clips 236, which are configured to prevent the prongs 232 from moving to the expanded position when the leveling assembly 220 is mounted to the chassis 12. While the locking feature is shown in the form of clips 236, it is possible to use any suitable locking feature to prevent the prongs 232 from moving to the expanded position when the leveling assembly 220 is mounted to the chassis 12.

A method for installing a leveling assembly 120 or 220 on a dishwasher 10 includes locating a threaded portion 124, 224, of a leveling foot 122, 222 into a leveling nut 130, 230 having internal threads 134, 234 without threading the leveling foot 122, 222 into the leveling nut 130, 230. Next, the method includes mounting the leveling nut 130, 230 with the threaded portion 124, 224 located within, to a base portion, such as a chassis 12 or base support 110 of the dishwasher 10. This can include snap-fitting the leveling nut 130, 230 to the chassis 12.

The method can also optionally include locating the threaded portion 124 into the leveling nut 130 including moving hinged portions, such as first and second sides $S_1$ and $S_2$ of the leveling nut 130 from an opened position to a closed position surrounding the screw body 124.

The method can optionally include locating the threaded portion 224 into the leveling nut 230 including flexing at least one portion of the leveling nut 230, such as prongs 232 and pressing the screw body 224 into the leveling nut 230, where flexing the at least one portion allows threads of the threaded portion 224 to slip past the internal threads 234.

The aspects of the disclosure described herein can be used to level a dishwasher, ensuring that the dishwasher is balanced. Aspects of the disclosure can be used to avoid the undesirable circumstances when performance issues arise due to an unbalanced dishwasher or when liquid accumulates in low areas of the dishwasher. It will be understood that while the aspects of the disclosure described herein are shown in the context of a dishwasher, the aspects of the disclosure can be utilized to level any household treating appliance.

To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher for treating dishes according to at least one automatic cycle of operation, comprising:

a tub at least partially defining a treating chamber;

a chassis at least partially supporting the tub and having a set of notches located at a base of the chassis; and a set of leveling assemblies mounted to the chassis, each leveling assembly comprising:

a leveling foot having a threaded shaft; and a nut having a clam-shell body having a threaded interior and having two opposing sides with a hinge located between the two opposing sides and where the two opposing sides are configured to move between an opened position where the threated interior is configured to receive a portion of the threaded shaft without threading the leveling foot, and a closed position, the clam-shell body having at least one of a set of projections or a set of clips;

wherein when the threaded shaft is located within the nut, and clam-shell body is closed, the nut is configured to be snap-fitted to the chassis, wherein the at least one of the set of projections or the set of clips is received in the set of notches, such that the nut is constrained within the chassis and the leveling foot is rotatable within the constrained nut for height adjustment of the chassis.

2. The dishwasher of claim 1 wherein the chassis comprises two opposing base supports.

3. The dishwasher of claim 2 wherein the chassis defines a space below the tub.

4. The dishwasher of claim 1, further comprising a leveling foot and nut at each corner of the chassis.

5. The dishwasher of claim 1 wherein the nut is configured to receive the threaded shaft when the two opposing sides are in the opened position and to be locked together when the two opposing sides are in the closed position.

6. The dishwasher of claim 5 wherein a first of the two opposing sides includes a clasp extending from the first of the opposing sides and a second of the two opposing sides includes a catch extending from the second of the two opposing sides and wherein the latch and catch engaged to locked together two opposing sides when the two opposing sides are in the closed position.

7. A leveling assembly for a dishwasher, comprising:

a leveling foot having a threaded shaft; and a nut having a clam-shell body with a threaded interior having two opposing sides with a hinge located between the two opposing sides and where the two opposing sides are configured to move between an opened position where the threated interior is configured to receive a portion of the threaded shaft without threading of the leveling foot and a closed position, the body including a locking feature configured to prevent movement of the two opposing sides from the closed position;

wherein when the threaded shaft is located within the nut, the nut is configured to be snap-fitted to a chassis such that the nut is constrained and the leveling foot is rotatable within the constrained nut for height adjustment of the chassis.

8. The leveling assembly of claim 7 wherein the nut is configured to receive the threaded shaft when the two opposing sides are in the opened position and to be locked together around the threaded shaft when the two opposing sides are in the closed position.

9. The leveling assembly of claim 7 wherein the nut further comprises a set of projections extending from the clam-shell body and where the projections are configured to mate with notches in the chassis such that the clam shell body is snap-fitted to the chassis.

10. A method for installing a leveling assembly on a dishwasher, comprising:

locating a threaded portion of a leveling foot having a screw body into a leveling nut having a clam-shell body having internal threads and having two opposing sides with a hinge located between the two opposing sides and where the two opposing sides are configured to move between an opened position where the threated interior is configured to receive a portion of the threaded shaft without threading the leveling foot, and a closed position, without threading the screw body into the leveling nut;

securing, via a clasp or interference fit, the leveling nut about the threaded portion; and mounting protrusions on the leveling nut, secured about the threaded portion, into notches in a base portion of the dishwasher.

11. The method according to claim 10 wherein mounting the leveling nut to the base portion of the dishwasher comprises snap-fitting the leveling nut to the base portion of the dishwasher.

* * * * *